US005146684A

United States Patent [19]

Hagler

[11] Patent Number: 5,146,684

[45] Date of Patent: Sep. 15, 1992

[54] MOLDED KNIFE SHEATH

[75] Inventor: James E. Hagler, La Mesa, Calif.

[73] Assignee: Buck Knives, Inc., El Cajon, Calif.

[21] Appl. No.: 737,188

[22] Filed: Jul. 29, 1991

[51] Int. Cl.[5] ..... B26B 29/02

[52] U.S. Cl. ..... 30/162; 30/151; 224/232

[58] Field of Search ..... 30/162, 151; 224/232, 224/247, 253

[56] References Cited

U.S. PATENT DOCUMENTS

| | | | |
|---|---|---|---|
| 1,508,382 | 9/1924 | Chatillon | 224/232 |
| 2,507,019 | 5/1950 | Johnson | 30/151 |
| 3,246,813 | 4/1966 | Miller | 30/162 |
| 4,428,515 | 1/1984 | Mayer | 224/232 |
| 4,726,448 | 2/1988 | Esposito | 224/232 |
| 5,002,213 | 3/1991 | Newton et al. | 30/162 |

FOREIGN PATENT DOCUMENTS

| | | | |
|---|---|---|---|
| 0268793 | 11/1990 | Japan | 224/232 |
| 2083599 | 3/1982 | United Kingdom | 224/232 |

*Primary Examiner*—Frank T. Yost
*Assistant Examiner*—Hwei-Siu Payer
*Attorney, Agent, or Firm*—Philip D. Junkins

[57] ABSTRACT

A one piece molded sheath for fixed blade knives having a blade portion and a contoured handle portion including a forefinger groove separated from the blade portion by a handle ridge. The sheath of the invention is comprised of a blade-contoured sheath pocket for receiving the blade portion and adjacent handle ridge of such knives. The molded sheath pocket has an elongated back wall, a shorter front wall and a pair of side walls interconnecting the front wall to the back wall. The back wall of the sheath pocket in its upper portion has molded-in belt loops for attaching the sheath to the belt of the wearer. A slot in the upper end of each of the side walls of the sheath pocket permit the forward and rearward flexing of the upper portion of the front wall with respect to the back wall by the handle ridge of such knives during insertion thereof into the sheath pocket and withdrawal thereof from such pocket. An opening in the upper portion of the front wall of the sheath pocket is provided for receiving the handle ridge of the handle portion of such knives upon insertion thereof into the sheath pocket for maintaining the knives within the sheath pocket against accidental dislodgement.

15 Claims, 1 Drawing Sheet

MOLDED KNIFE SHEATH

BACKGROUND OF THE INVENTION

1. Field of the Invention

The present invention relates to sheaths for knives. More particularly, the invention relates to sheaths for fixed blade knives wherein the sheaths are adapted for attachment to belts worn by the user.

2. Description of the Prior Art

Classically, sheaths for fixed blade knives have been made of leather and include a blade-contoured pocket defined by front and rear strips of leather which are affixed to one another by stitching. Frequently the blade pocket is reinforced in its edge stitching periphery by rivets. The rear leather strip usually extends beyond the upper end of the blade pocket and includes belts slots for mounting the sheath to the wearers belt. Also, the upper end portion of the rear leather strip bears a safety strap (usually with a snap fastener) which surrounds the knife handle and maintains the knife within the sheath against accidental dislodgement.

In recent years knife sheaths for fixed blade knives have also been fabricated from high strength fabrics including tightly woven nylon fabric materials. Both leather and fabric knife sheaths are subject to wear and tear and when they become soiled can not be easily cleaned.

It is an object of the present invention to provide a sheath for fixed blade knives which is of one piece molded plastic construction.

It is a further object of the invention to provide a sheath for fixed blade knives which can be injection molded of polyethylene or other suitable plastic material.

It is another object of the invention to provide a sheath for fixed blade knives which is of one piece molded construction and includes support means for removably attaching the sheath to the belt of the wearer.

It is a still further object of the invention to provide a sheath for fixed blade knives which is of one piece molded construction and which includes means at the upper end of the blade pocket for gripping the knife handle to maintain the knife from accidental dislodgement from the sheath.

It is yet another object of the present invention to provide a sheath for fixed blade knives molded of suitable plastic material which is sufficiently strong to resist abusive use and is still sufficiently flexible in its upper blade pocket structure to allow the insertion of the blade into the pocket with gripping retention of the knife within the sheath against accidental dislodgement.

It is still another object of the invention to provide a sheath for fixed blade knives which is of one piece molded construction and which does not require a safety strap for maintaining the knife within the sheath to protect the knife from accidental dislodgement from the sheath.

It is a still further object of the invention to provide, in combination, a fixed blade knife with molded handle and a one piece molded sheath including a blade-contoured pocket for receiving the knife blade, the upper end of the blade-contoured pocket including means for gripping the handle of the knife to maintain the knife within the sheath against accidental dislodgement.

Other objects and advantages of the invention will be apparent from the following summary and detailed descriptions of the invention, taken together with the accompanying drawing figures.

SUMMARY OF THE INVENTION

The present invention relates to an improved sheath for fixed blade knives which is of one piece molded construction. The sheath structure includes a blade-contoured pocket having an elongated back wall, a shorter front wall, and side walls. The blade pocket is of sufficient length so that when the knife is seated in the sheath the lower portion of the knife handle or hilt is encompassed by the pocket. The front wall of the blade pocket includes, at its upper end, an opening for receiving a raised portion of the handle of the seated knife whereby the knife may be maintained within the sheath against accidental dislodgement. The side walls of the blade pocket each include, at their upper end, a slot whereby when the knife is inserted into the sheath the front wall of the blade pocket (at its upper end) is permitted to flex outwardly so that the raised portion of the handle of the knife can slip into the front wall opening for retainment of the knife within the sheath.

The upper end of the elongated back wall of the sheath includes molded-in belt loops for removable attachment of the sheath to the belt of the wearer. The lower end of the molded sheath structure (at the lower tip end of the blade-contoured pocket) includes an opening or port whereby the inside of the sheath can be readily cleaned, as by washing, with the cleaning fluid flushed through the blade pocket. The structure of the sheath of the present invention is such that it can be readily injection molded of high density polyethylene or other suitable plastic molding material.

BRIEF DESCRIPTION OF THE DRAWING FIGURES

Figure 1:
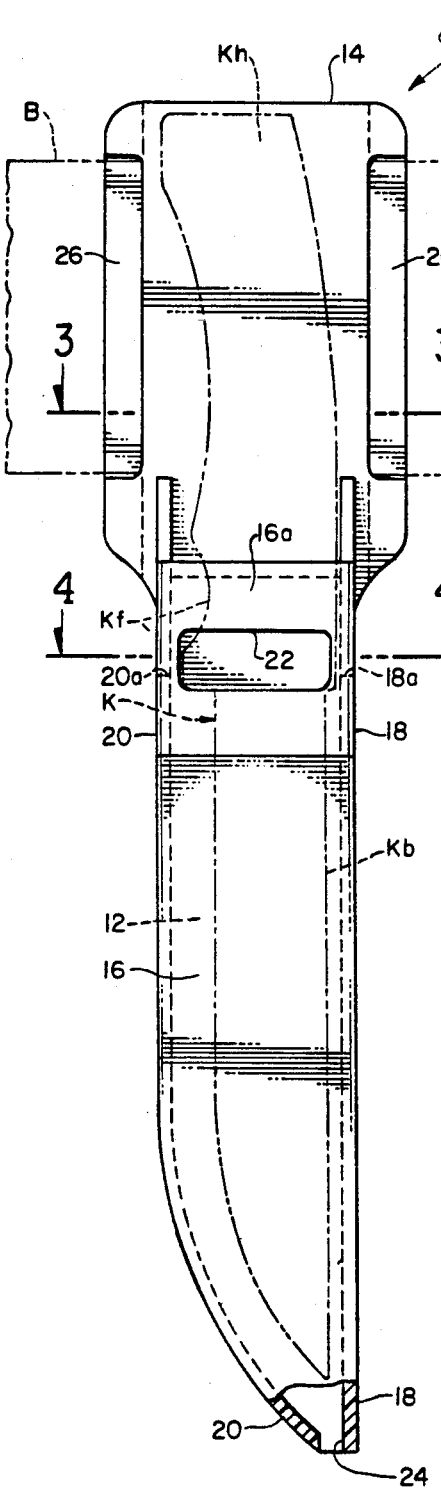
FIG. 1 is a front elevation view of a knife sheath illustrating an embodiment of the invention with its mating knife shown in phantom and seated therein.
Figure 2:
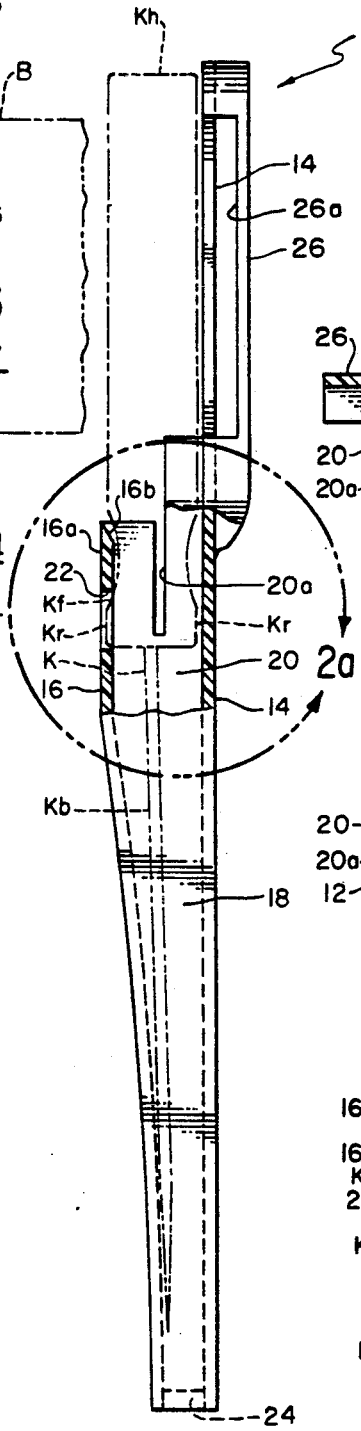
FIG. 2 is a right side elevation view (partially in section) of the knife sheath shown in FIG. 1 with the mating knife shown in phantom.
Figure 3:
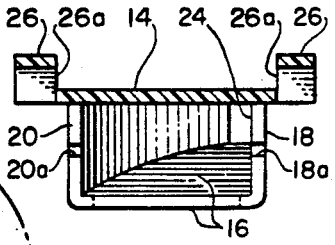
Figure 2A:
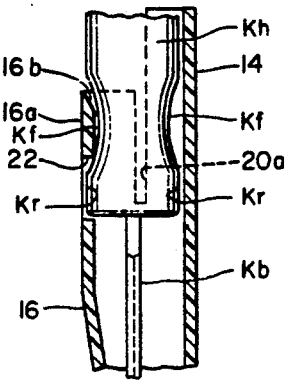

FIG. 2*a* is a partial right side elevation view (in section) of the knife sheath of FIG. 1 with the lower part of the handle of the mating knife shown in its and locked-in position within the sheath;

FIG. 3 is a sectional view taken on line 3—3 of FIG. 1; and

Figure 4:
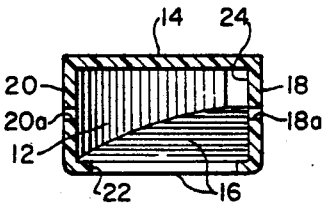

FIG. 4 is a sectional view taken on line 4—4 of FIG. 1.

DETAILED DESCRIPTION OF THE INVENTION

The present invention relates to an improved sheath for fixed blade knives molded of suitable plastic material which is sufficiently strong to resist abusive use and is still sufficiently flexible in its upper blade pocket structure to allow the insertion of the blade into the pocket with gripping retention of the knife within the sheath. Referring initially to FIGS. 1 and 2 of the drawing sheet, there is illustrated a preferred form of the molded knife sheath 10 of the invention. The sheath structure includes a blade-contoured pocket 12 having an elongated back wall 14, a shorter front wall 16, and side walls 18 and 20. The blade pocket 12 is of sufficient length so that when a knife is seated within the sheath the lower portion of the knife handle or hilt is encompassed by the upper end of the blade pocket.

To fully illustrate the blade pocket structure 12 of the knife sheath 10 of the invention, and the knife restraining features thereof, a mating fixed blade knife K is shown in phantom outline in its seated position within the sheath. The knife K includes blade Kb and handle Kh with the handle portion contoured for ease of gripping by the user. A distinct forefinger groove Kf is provided in the handle Kh immediately behind the end handle ridge Kr which separates the handle portion of the knife from the knife blade.

The front wall 16 of the blade pocket 12 of the sheath 10 includes, at its upper end, a generally rectangular opening 22 for receiving the handle ridge Kr of the seated knife K whereby the knife is maintained within the sheath against accidental dislodgement. The front wall opening 22 is defined at its upper end by terminal portion 16*a* of the front wall 16. The upper edge of the terminal portion 16*a* is provided with an inner lead angle surface 16*b* to allow the handle ridge Kr to enter the upper end of the blade pocket 12. The distance between the inner surface of the terminal portion 16*a* of the front wall and the opposing inner surface of rear wall 14 of the sheath is less than the thickness of the handle ridge Kr of knife K. To accommodate the insertion of the knife K into the sheath with the handle ridge Kr force slipped past the lead angle surface 16*b* and between the terminal portion 16*a* of the front wall and the rear wall 14, the side walls 18 and 20 include, at their upper ends, slots 18*a* and 20*a*, respectively. Thus, when the knife is inserted into the sheath the front wall 16 of the blade pocket 12 (at its upper terminal portion 16*a*) is permitted to flex outwardly so that the handle ridge Kr of the knife can slip into front wall opening 22. After the handle ridge Kr is seated within the opening 22 of the front wall the upper terminal portion 16*a* of front wall 16 returns to its unflexed position with the knife being retained within the sheath against accidental dislodgement as shown in FIG. 2*a*. During withdrawal of the knife from the sheath the upper terminal portion 16*a* of the front wall 16 flexes outwardly so that the handle ridge Kr of the knife can slip out of the front wall opening 22. After knife withdrawal the terminal portion 16*a* of front wall 16 returns to its un-flexed position.

The lower end of the molded sheath structure 10, at the lower tip end of the blade-contoured pocket 12, includes an opening or port 24 whereby the inside of the sheath can be readily cleaned, as by washing, with the cleaning fluid flushed through the blade pocket. The upper end of the elongated back wall 14 of the knife sheath 10 includes molded-in belt loops 26 on each side of the sheath. The belt loops are off-set to the rear of the back wall and provide openings 26*a* for insertion of the wearer's belt and thereby removable attachment of the sheath, via the belt loops, to the belt. The wearer's belt B is shown in phantom outline in FIG. 1 of the drawing sheet.

By reference to FIG. 1 it will be noted that the front wall 16 of the blade pocket 12 is contoured inwardly from a point below the upper end thereof to the lower end of the pocket. Although this inward contour of the blade pocket 12 adds to the aesthetic outward appearance of the molded knife sheath of the present invention, it is of equal importance in providing molding draft within the pocket so that the injection molding of the entire sheath structure can be accomplished. The inward contour of the front wall 16 of the blade pocket 12 is further illustrated in FIGS. 3 and 4 which are comprised, respectively, of sectional views of the knife sheath taken on lines 3—3 and 4—4, respectively, of FIG. 1. These figures also show the positions of the side slots 18*a* and 20*a* in side walls 18 and 20, respectively, which permit flexing movement of the end portion 16*a* of the front wall 16. Further, these figures show the position of the port 24 at the lower tip end of the sheath's blade pocket 12.

The advantages of the molded knife sheath of the invention are manifest. The sheath is of one piece construction and requires no material stitching and/or riveting. It is sufficiently strong to resist abusive use and is still sufficiently flexible in its upper blade pocket structure to allow the insertion of the blade into the pocket with gripping retention of the knife within the sheath against accidental dislodgement. The sheath does not require a safety strap to retain the knife therein and the sheath can be easily cleaned (both inside and outside of the blade pocket) by washing without an adverse affect to the plastic material of construction. The sheath may be molded of any suitable injection moldable plastic material including polyethylene, polypropylene, polystyrene and vinyl acetate.

In the specification and drawing figures there has been set forth a preferred embodiment of the invention and although specific terms have been employed to describe the invention, they are used in a generic and descriptive sense only and not for purposes of limitation, the scope of the invention being defined in the following claims.

What I claim is:

1. A one piece molded sheath for a fixed blade knife having a blade and a handle extending from the blade and including a forefinger groove separated from the blade by a handle ridge, said molded sheath comprising:

a sheath body defining a blade-contoured sheath pocket having an open upper end for receiving the blade and the handle ridge of said fixed blade knife, said sheath body having an elongated back wall, a shorter front wall, and a pair of side walls interconnecting said front wall to said back wall;

slots in an upper end portion of the side walls of said sheath body, said slots permitting forward and rearward flexing of an upper portion of said front wall with respect to said back wall by the handle ridge of said knife during insertion of the blade and handle ridge thereof into said pocket and withdrawal thereof from said pocket; and an opening in the upper portion of the front wall of said sheath body for receiving the handle ridge of said knife upon insertion of said knife blade into said pocket and for maintaining said knife within said sheath against accidental dislodgement.

2. A one piece molded sheath for a fixed blade knife as claimed in claim 1 wherein the handle ridge of said knife has a thickness which is greater in dimension than a distance dimension between the front wall and the back wall of said sheath body whereby said handle ridge effects the forward flexing of the upper portion of said front wall during the insertion and withdrawl of said knife from said sheath.

3. A one piece molded sheath for a fixed blade knife as claimed in claim 1 wherein the elongated back wall of said sheath body in its upper end portion at the edges thereof includes means for attaching said sheath to a belt of a wearer of said sheath.

4. A one piece molded sheath for a fixed blade knife as claimed in claim 3 wherein the means for attaching said sheath to the belt of the wearer comprises belt loops molded into the edges of the upper end portion of the elongated back wall of said sheath body on each side thereof.

5. A one piece molded sheath for a fixed blade knife as claimed in claim 1 wherein the front wall of said sheath body in its lower portion and a lower portion of said elongated back wall of said sheath body are mated to establish the blade-contoured shape of said pocket and the side walls interconnecting said front wall to said back wall conform to said shape and leave a port at a lower end of said pocket.

6. A one piece molded sheath for a fixed blade knife having a blade portion and a contoured handle portion extending from the blade portion and including a forefinger groove separated from the blade portion by a handle ridge, said sheath comprising:

a sheath body defining a blade-contoured sheath pocket open at its upper end for receiving the blade portion and the handle ridge of said fixed blade knife, said sheath body having an elongated back wall having a blade-contoured shape in its lower portion, a shorter front wall having a mating blade-contoured shape, and a pair of side walls interconnecting said front wall to said back wall, said back wall in its upper portion at the edges thereof having means for attaching said sheath to a belt of a wearer of said sheath;

a slot in an upper end portion of each of the side walls of said sheath body, said slots permitting forward and rearward flexing of an upper portion of said front wall with respect to said back wall by the handle ridge of said knife during insertion thereof into said pocket and withdrawal thereof from said pocket; and an opening in the upper portion of the front wall of said sheath body for receiving the handle ridge of said knife upon insertion of said knife blade into said pocket and for maintaining said knife within said sheath against accidental dislodgement.

7. A one piece molded sheath for a fixed blade knife as claimed in claim 6 wherein the handle ridge of the handle portion of said knife has a thickness which is greater in dimension than a distance dimension between the front wall and the back wall of said sheath body whereby said handle ridge effects the forward flexing of the upper portion of said front wall during the insertion of said knife into said sheath and during the withdrawl of said knife from said sheath.

8. A one piece molded sheath for a fixed blade knife as claimed in claim 6 wherein the means for attaching said sheath to the belt of the wearer comprises belt loops molded into edges of an upper portion of the elongated back wall of said sheath body on each side thereof.

9. A one piece molded sheath for a fixed blade knife as claimed in claim 6 wherein the blade-contoured shape of the front wall of said sheath body and the mating blade-contoured shape of the lower portion of said elongated back wall of said sheath body establish the blade-contoured shape of said sheath pocket and said side walls interconnecting said front wall to said back wall conform to said shape and leave a port at a lower end of said pocket.

10. A one piece molded sheath for a fixed blade knife as claimed in claim 6 wherein said sheath is injection molded from a plastic selected from the group of moldable plastics including polyethylene, polypropylene, polystyrene and vinyl acetate.

11. In combination: a fixed blade knife having a blade portion and a handle portion including a forefinger groove separated from the blade portion by a handle ridge; and a one piece molded plastic sheath for said knife including a sheath body defining a blade-contoured pocket open at its upper end for receiving the blade portion of said knife and the handle ridge of the handle portion thereof, said sheath body comprised of an elongated back wall, a shorter front wall, and a pair of side walls interconnecting said front wall to said back wall, said side walls each having a slot in an upper end portion thereof, the slots of said side walls permitting forward and rearward flexing of an upper portion of said front wall with respect to said back wall by the handle ridge portion of said knife during insertion thereof into the pocket of said sheath body and withdrawal thereof from said pocket, and an opening in the upper end portion of the front wall of said sheath body for receiving said handle ridge upon insertion of said knife into said pocket, the forward and rearward flexibility of the upper portion of said front wall and the opening in the upper end portion of said front wall providing means for releasably gripping the handle ridge of the handle portion of said knife to maintain the knife within the sheath body when seated therein against accidental dislodgement.

12. The combination of a fixed blade knife and a one piece molded plastic sheath as claimed in claim 11 wherein the handle ridge of the handle portion of said knife has a thickness which is greater in dimension than a distance dimension between the front wall and the back wall of said sheath body whereby said handle ridge effects the forward flexing of the upper portion of said front wall during the insertion and withdrawal of said knife from said sheath.

13. The combination of a fixed blade knife and a one piece molded plastic sheath as claimed in claim 11 wherein the elongated back wall of said sheath body in its upper end portion at the edges thereof includes means for attaching said sheath to a belt of a wearer of said sheath.

14. The combination of a fixed blade knife and a one piece molded plastic sheath as claimed in claim 13 wherein the means for attaching said sheath to the belt of the wearer comprises belt loops molded into edges of an upper end portion of the elongated back wall of said sheath body on each side thereof.

15. The combination of a fixed blade knife and a one piece molded plastic sheath as claimed in claim 11 wherein the front wall of said sheath body and the mating lower portion of said elongated back wall of said sheath body establish the blade-contoured shape of said pocket and said side walls interconnecting said front wall to said back wall conform to said shape and leave a port at a lower end of said pocket.

* * * * *